United States Patent [19]

Cleary et al.

[11] 4,265,861

[45] May 5, 1981

[54] METHOD OF REDUCING RADIOACTIVE WASTE AND OF RECOVERING URANIUM FROM IT

[75] Inventors: James G. Cleary, Dormont; Gregory E. Zymboly, Penn Hills, both of Pa.

[73] Assignee: Wyoming Mineral Corporation, Lakewood, Colo.

[21] Appl. No.: 10,566

[22] Filed: Feb. 9, 1979

[51] Int. Cl.[3] ..... G21F 9/30

[52] U.S. Cl. ..... 423/10; 75/103; 75/121; 252/301.1 W; 423/2; 423/11; 423/16; 423/17

[58] Field of Search ..... 423/10, 11, 17, 18, 423/2, 173, 16; 299/4, 5; 75/103, 101 R, 121; 252/301.1 W

[56] References Cited

U.S. PATENT DOCUMENTS

| | | | |
|---|---|---|---|
| 2,812,232 | 11/1957 | Delaplaine | 423/18 |
| 3,086,841 | 4/1963 | Hart et al. | 423/17 |
| 3,792,903 | 2/1974 | Rhoades | 423/17 |
| 4,054,320 | 10/1977 | Learmont | 299/4 |

OTHER PUBLICATIONS

Merritt, R. C., *The Extractive Metallurgy of Uranium*, Colo. School of Mines, Research Institute (1971) pp. 247, 248, 304–306.

*Primary Examiner*—Deborah L. Kyle
*Attorney, Agent, or Firm*—R. D. Fuerle

[57] ABSTRACT

A method is described for reducing the volume of radioactive waste produced during the solution mining of uranium and for recovering uranium from it. The recovery leach, which contains uranium in solution and is supersaturated with calcium carbonate, is treated with bicarbonate and made basic which precipitates calcium carbonate and some of the uranium. The precipitated calcium carbonate is dissolved with acid and the uranium in the solution is removed by extraction or precipitation. The remaining solution is contacted with sulfate ions and barium or strontium ions to precipitate $BaSO_4.RaSO_4$ or $SrSO_4.RaSO_4$, the principal radioactive constituent in the solid waste product.

12 Claims, No Drawings

METHOD OF REDUCING RADIOACTIVE WASTE AND OF RECOVERING URANIUM FROM IT

BACKGROUND OF THE INVENTION

In uranium solution mining processes stripping solutions are injected underground where they solubilize uranium. The recovery solutions are pumped to the surface and are processed to remove the uranium. These recovery solutions, however, are frequently supersaturated with dissolved calcite (calcium carbonate). The calcium carbonate must be precipitated before the solution can be processed, otherwise the calcium carbonate precipitates throughout the processing equipment, rendering it inoperable.

When the calcium carbonate precipitates some of the uranium in solution precipitates with it, causing a loss of uranium and creating a radioactive waste disposal problem. Moreover, radium, a daughter product of uranium, is also dissolved in the stripping solution and is also precipitated with the uranium, further increasing the radioactivity of the precipitate.

While some processes are being used to recover the uranium from the calcium carbonate precipitate, they still leave large quantities of solid waste contaminated with radioactive radium. Disposal of radioactive waste is very expensive. The waste must be placed in steel drums, transported to a disposal site, and stored in a guarded area. Reduction in the quantity of solid wastes is therefore very desirable as it reduces the danger of environmental contamination and the cost of storage.

PRIOR ART

"The Extractive Metallurgy of Uranium", by R. C. Merritt discloses (pages 247 to 248) the precipitation of uranium using hydrogen peroxide, and (pages 304 to 306) the precipitation of radium sulfate with barium sulfate.

SUMMARY OF THE INVENTION

We have discovered a process which substantially reduces the quantity of radioactive waste produced by the solution mining of uranium. In addition, our process recovers most of the uranium which precipitates with the calcium carbonate.

DESCRIPTION OF THE INVENTION

In the solution mining of uranium a stripping solution is prepared which is pumped into the underground uranium deposit through a number of injection wells. The stripping solution commonly consists of an aqueous solution of an oxidant and a bicarbonate. The oxidant is usually hydrogen peroxide because it is less expensive, but potassium permanganate, sodium hypochlorite, or other suitable oxidant could also be used. The bicarbonate ion is usually obtained by adding ammonium bicarbonate but sodium bicarbonate or soluble carbonates could also be used.

The recovery leach containing the dissolved uranium is pumped to the surface for processing. A commerical recovery leach typically contains about 0.05 to about 0.5 gms per liter of dissolved uranium as ammonium uranyl carbonate. $(NH_4)_2\ UO_2\ (CO_3)_3$, if ammonium bicarbonate was used as the source of bicarbonate ion. The recovery leach also contains small concentrations of highly radioactive radium. Typically the precipitated calcium carbonate would contain about 500 to about 1000 piCi of radium per gram of $CaCO_3$.

This invention is useful with carbonate recovery leaches. The recovery leach is typically supersaturated with calcium carbonate, containing about 0.3 to about 1.0 gms per liter of calcium carbonate. Because the large concentrations of calcium carbonate in the recovery leach can result in the precipitation of calcium carbonate throughout the precessing equipment, which would render it inoperable, it is first necessary to precipitate this calcium carbonate. Precipitation is preferably induced by the addition of ammonia to a pH of about 8.2. Carbon dioxide is also added slightly in excess of the calcium present (about 10%). The amount of ammonia can be about 1 to about 2 gms/1, and the amount of carbon dioxide about 1.0 to about 2.0 gms/1. Precipitation of the calcium carbonate can also be accomplished using carbon dioxide in combination with Na, $CO_3$, MgOH, or $Ca(OH)_2$.

The calcium carbonate precipitate typically contains about 20 to about 30 pounds of uranium per ton of calcium carbonate and about $9\times10^8$ piCi of radium per ton of calcium carbonate. About 15% of the uranium in the recovery leach is precipitated with the calcium carbonate. This precipitation can be accomplished in a reactor-clarifier. The precipitate can be removed as a slurry containing, for example, about 30% solids. The slurry is preferably sent to a settling pond to further separate the solids from the solution. The solids are then removed by suction pump, screw feeder, or other means and are sent to a dissolution reactor.

In the dissolution reactor an acid is added which will dissolve the calcium carbonate. Hydrochloric acid is preferred as it is the least expensive, but nitric acid or other acids which do not form insoluble compounds with calcium (e.g., sulfuric acid) could also be used. Sufficient acid is used to effect the dissolution of all of the calcium carbonate. The carbon dioxide which is evolved can be collected if desired. If hydrochloric acid is used, the uranium forms soluble uranyl chloride, $UO_2Cl_2$, at this stage.

The solution is then sent to a uranium reclamation system where uranium is removed from the solution. Uranium removal can be accomplished by solvent extraction, peroxide precipitation, or other suitable process. Solvent extraction gives a higher precentage yield and a cleaner product, but it is not preferred to a peroxide precipitation.

In solvent extraction the aqueous solution is mixed with a counterflowing immiscible organic liquid containing a uranium extractant. The commercially used organic fluid is kerosene because it is inexpensive, and the commercial extractant is a mixture of diethylhexyl phosphoric acid (DEHPA) and trioctyl phosphene oxide (TOPO). Other organic fluids and other extractants, such as amines or tributyl phosphate, can be used if desired.

Peroxide precipitation can be accomplished by the addition of any peroxide to the solution to precipitate uranyl peroxide, $UO_4.\ 2H_2O$. Hydrogen peroxide is preferred as it is inexpensive, but $Na_2O_2$, or $K_2O_2$ could also be used. The amount of peroxide used should be about 0.12 pounds per pound of $U_3O_8$ (i.e., stoichiometric) up to about a 10% excess. The pH of the solution should be adjusted to between about 3.5 and about 5.5 because below a pH of about 3 the uranium does not precipitate quantitatively and above a pH of about 5.5 the uranium precipitates as other compounds besides uranyl peroxide. Less peroxide can be used at higher pH's and at higher temperatures (i.e., up to about 50° C.).

When the uranium is removed the solution is sent to a precipitator where the radium is precipitated out. This is accomplished by adding sulfate ions and barium or strontium ions which precipitates $BaSO_4$. $RaSO_4$ or $SrSO_4$. $RaSO_4$, respectively. The barium or strontium ions are preferably obtained by the addition of barium or strontium chloride, but other soluble barium or strontium compounds such as BaO or SrO, could also be used. The sulfate ions may be obtained by the addition of any inexpensive, soluble sulfate. Ammonium sulfate, sulfuric acid, sodium sulfate, or other suitable sulfates can be used. Radium sulfate is very insoluble, but is present in very small amounts. The amount of sulfate and barium or strontium ions should be about stoichiometric up to about a 5% excess of stoichiometry of the amount needed to form $MSO_4$. $RaSO_4$ where M is Ba or Sr.

The solid $MSO_4$. $RaSO_4$ is radioactive and must be stored as radioactive waste. This invention reduces the amount of this radioactive waste from about 18.2 cubic feet per ton of calcium carbonate to only about 2.0 cubic feet per ton of calcium carbonate. The effluent, a solution of calcium chloride, is not radioactive. It can be added to ground water and deep well disposed or placed in ponds to crystallize and recover the calcium chloride.

The following example further illustrates this invention.

EXAMPLE 1316 gms of calcium carbonate obtained from the precipitation of uranium recovery leach was dissolved in 1.54 liters of concentrated HCl. The pH was adjusted with the same calcium carbonate to 3. There were 854 gms of $CaCO_3$ per liter of solution. The solution was filtered and contacted with 0.3 M DEPHA-0.075 M TOPA in kerosene in various ratios of organic to aqueous. The concentration of uranium in the initial solutions was 3.9 gms/l. The phases were permitted to separate and a sample of the $CaCl_2$ solution was analyzed for uranium.

The following results were obtained:

| Organic-Aqueous Ratio | Uranium in Solution After Extraction (gms/l) | Uranium Extracted (%) |
|---|---|---|
| 0.5 | 0.0064 | >99 |
| 0.33 | 0.0063 | >99 |
| 0.25 | 0.053 | 98.6 |

150 ml of the $CaCl_2$ solution was contacted with 6.7 ml of a 2.5 M solution of ammonium sulfate and 17.4 ml of a 1 M solution of barium chloride. The precipitate was weighed and the radium remaining in a 40 ml sample of the solution was determined. The remaining solution was again contacted with 2.5 M ammonium sulfate and 1 M barium chloride and the procedure repeated. A third contact was also made. The following table gives the results:

| Starting Vol (ml) | Volume of $BaCl_2$ (ml) | Volume of $(NH_4)_2SO_4$ (ml) | Final Volume (ml) | Weight of Precipitate (gms) | Dilation Factor | Radium (pici/l) |
|---|---|---|---|---|---|---|
| Feed | — | — | — | — | — | $2.35 \times 10^5$ |
| 150 | 17.4 | 6.98 | 174.38 | 8.986 | 1.16 | $1.49 \times 10^4$ |
| 134 | 15.6 | 6.2 | 155.8 | 6.3699 | 1.35 | 500 ± 100 |
| 100 | 11.6 | 4.7 | 116.3 | 4.1977 | 1.57 | 100 |

The dilution factor is the amount that the sample was diluted by the addition of the ammonium sulfate and barium chloride solutions. The table shows that the invention successfully reduced the level of radium in the solution to levels tolerable for release into the environment.

We claim:

1. In a process for recovering uranium from a recovery leach supersaturated with calcium carbonate, an improved method of recovering uranium from said recovery leach and of reducing radioactive waste containing radium, comprising (1) precipitating calcium carbonate from said recovery leach;

(2) separating said precipitated calcium carbonate from said recovery leach;

(3) dissolving said precipitated calcium carbonate with acid to form a solution of radium, uranium, and calcium carbonate;

(4) removing said uranium from said solution;

(5) precipitating $MSO_4$. $RaSO_4$ from said solution by adding $SO_4^{=}$ and $M^{++}$ ions, where M is Ba or Sr; and (6) separating said precipitated $MSO_4$. $RaSO_4$ from said solution.

2. A method according to claim 1 wherein said calcium carbonate is precipitated by adding bicarbonate ions and an oxidant.

3. A method according to claim 2 wherein said oxidant is hydrogen peroxide and said bicarbonate ions are obtained by adding ammonium bicarbonate.

4. A method according to claim 1 wherein said precipitated calcium carbonate is separated from said recovery leach by settling in a settling pond.

5. A process according to claim 1 wherein said acid is hydrochloric acid.

6. A process according to claim 1 wherein said uranium is removed by extraction with an organic solvent containing an extractant.

7. A process according to claim 6 wherein said organic solvent is kerosene.

8. A process according to claim 6 or 7 wherein said extractant is a mixture of diethylhexyl phosphoric acid and trioctyl phosphene oxide.

9. A process according to claim 1 wherein said uranium is removed by precipitation with a peroxide.

10. A process according to claim 9 wherein said peroxide is hydrogen peroxide.

11. A process according to claim 9 or 10 wherein the pH during precipitation is about 3 to about 5.5.

12. A process according to claim 1 wherein M is barium.

* * * * *